United States Patent [19]

Burundukov

[11] 4,397,012

[45] Aug. 2, 1983

[54] ELECTRODYNAMIC PICKUP CARTRIDGE HAVING SIMPLIFIED COIL STRUCTURE

[76] Inventor: Valentin M. Burundukov, ulitsa Entuziastov, 14a, kv. 14, Chelyabinsk, U.S.S.R.

[21] Appl. No.: 201,070

[22] PCT Filed: Nov. 30, 1979

[86] PCT No.: PCT/SU79/00122

§ 371 Date: Aug. 26, 1980

§ 102(e) Date: Aug. 21, 1980

[87] PCT Pub. No.: WO80/01428

PCT Pub. Date: Jul. 10, 1980

[30] Foreign Application Priority Data

Dec. 26, 1978 [SU] U.S.S.R. ..... 2701590

[51] Int. Cl.[3] ..... H04R 9/16

[52] U.S. Cl. ..... 369/136; 369/147

[58] Field of Search ..... 369/136, 139, 146–149, 369/170–172

[56] References Cited

U.S. PATENT DOCUMENTS

| | | | |
|---|---|---|---|
| 1,768,377 | 6/1930 | Serduke | 369/146 |
| 3,014,993 | 12/1961 | Narma | 369/146 |
| 4,209,669 | 6/1980 | Hayashi | 369/136 |
| 4,237,347 | 12/1980 | Burundukov et al. | 369/146 |

FOREIGN PATENT DOCUMENTS

| | | | |
|---|---|---|---|
| 55-34554 | 3/1980 | Japan | 369/146 |

OTHER PUBLICATIONS

High-Class Pickup Cartridge; Praktiker, 1977, vol. 33, N24, Asterr., p. 37.

cf. Orthophone SPUT Cartridge; A. N. Bektabegov; "Stereophonic Pickups", Energy publishers, Moscow, 1964.

Electromagnetic Pickup; E. Ahrens, Erhard, Dr., 2300 Kiel; Knospe, Dieter, 2308 Preetz, Wichmann, Burkhard, 2300 Kiel 1979; No. 17.

High-Class Pickup Cartridge; Spitzenklasse-Tonabnehmersystem, "Praktiker", (Asterr.), 1977, 33, No. 24,37.

*Primary Examiner*—Raymond F. Cardillo, Jr.

*Attorney, Agent, or Firm*—Fleit, Jacobson & Cohn

[57] ABSTRACT

An electrodynamic pickup cartridge comprises two reproduction channels (1 and 2). Each channel (1 and 2) is provided with a cylindrical coil (3 and 4) representing a single-section structure and so disposed relative to its magnet (5 and 6) that it encompasses both poles (N and S) of said magnet and longitudinal axis thereof is perpendicular to the axis of said magnet (5 and 6) along the N-S line. The magnets (5 and 6) are installed on a stylus holder (7) which is common to both channels (1 and 2) and carries a stylus (8) so that unlike poles (N and S) thereof project on both sides of the stylus holder (7), while their axes (9 and 10) along the N-S line are found in planes crossing at a standard recording angle ($\alpha$).

2 Claims, 3 Drawing Figures

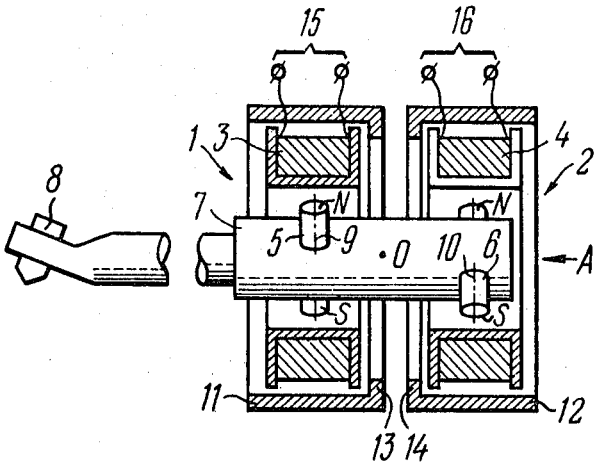
FIG.1
FIG.2
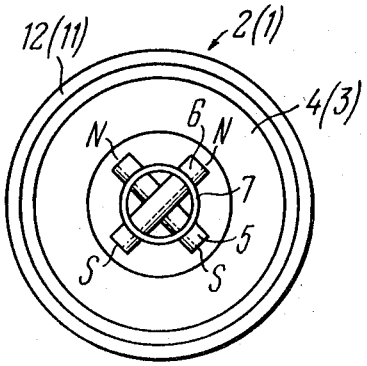
FIG.3
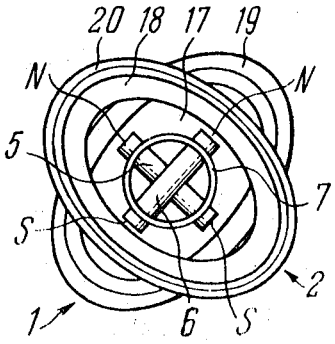

ELECTRODYNAMIC PICKUP CARTRIDGE HAVING SIMPLIFIED COIL STRUCTURE

FIELD OF THE INVENTION

The present invention relates to means for reproducing recorded sound by the use of a stylus and in particular to electrodynamic pickup cartridges.

PRIOR ART

Known in the art are electrodynamic pickup cartridges with coils moving back and forth in a magnetic field set up by a magnetic system (cf. Orthophone SPUT cartridge; A. N. Bektabegov "Stereophonic Pickups," "Energy" publishers, Moscow, 1964).

The aforesaid cartridges comprise a constuctionally intricate and bulky magnetic system composed of a permanent magnet and cores to produce a uniform magnetic field. As stated above, such cartridges incorporate moving coils which are difficult to manufacture and have a small number of turns, a disadvantage resulting in a low e.m.f. This calls for the utilization of a step-up transformer, which also complicates the construction of the afore-mentioned cartridges. In such cartridges the e.m.f. is produced essentially in the same manner as in systems wherein a frame is moved back and forth in a magnetic field.

Also known in the art are electrodynamic pickup cartridges comprising two reproduction channels provided with cylindrical coils accommodating permanent magnets installed on a stylus holder which is common to both channels and carries the stylus so that unlike poles thereof project on both sides of the stylus holder and their axes along the N-S line are found in planes crossing at a standard recording angle (cf. cartridge disclosed in U.S. Pat. No. 4,237,347 obtained by, among others, the present inventor).

In such cartridges the coil of each reproduction channel represents a two-section structure. Each section of the coil encompasses one of the pokes of a respective magnet. The coil is so disposed relative to its magnet that the longitudinal axis thereof coincides with the magnet axis along the N-S line. This substantially complicates production and construction of the cartridges and prevents replacement of a stylus holder by the user in operation since the coil sections are to be drawn apart to enable stylus holder replacement, a disadvantage necessitating disassembly of the cartridges.

BRIEF SUMMARY OF THE INVENTION

The present invention resides in providing an electrodynamic pickup cartridge wherein a coil structure permits substantially simplifying construction and production of the cartridge and assures easy replacement of a stylus holder by the user in operation.

The foregoing object is accomplished by that in an electrodynamic pickup cartridge comprising two reproduction channels provided with cylindrical coils accommodating permanent magnets installed on a stylus holder which is common to both channels and carries a stylus so that unlike poles thereof project on both sides of the stylus holder, while their axes along the N-S line are found in planes crossing at a standard recording angle, according to the invention, the coil of each reproduction channel represents a single-section structure so disposed relative to its magnet that it encompasses both poles of said magnet and longitudinal axis thereof is perpendicular to the axis of said magnet along the N-S line.

Preferably the cylindrical coil of each reproduction channel is elongated in cross-section and oriented so that turns thereof are close to the poles of the magnet of its channel and far from the poles of the magnet of the other channel.

The electrodynamic pickup cartridge forming the subject of the present invention boasts of simplier construction and easier production procedure. Furthermore, it permits bringing the magnet of one channel closer to the magnet of the other channel, which generally improves dynamic properties of the stylus holder, another advantage being the possibility of stylus holder replacement without disassembly of the cartridge.

BRIEF DESCRIPTION OF THE DRAWINGS

The invention will now be described further with reference to specific embodiments thereof, taken in conjunction with the accompanying drawings, wherein:

FIG. 1 is a general view of an electrodynamic pickup cartridge according to the invention (partial longitudinal section view);

FIG. 2 is a side view along the arrow A of FIG. 1; and

FIG. 3 depicts another embodiment of the cartridge according to the invention (side view).

DETAILED DESCRIPTION OF THE INVENTION

The electrodynamic pickup cartridge forming the subject of the present invention comprises two reproduction channels 1 and 2 (FIG. 1). Each reproduction channel 1 and 2 includes, it its turn, cylindrical coils 3 and 4 accommodating permanent magnets 5 and 6 installed on a stylus holder 7 which is common to the two channels 1 and 2 and carries a stylus 8. As seen from FIG. 2 the magnets 5 and 6 extend through the body of the stylus holder 7 and are arranged so that their unlike poles N (FIG. 1) and S project on both sides of the stylus holder 7, while axes 9 and 10 thereof along the N-S line are found in planes crossing at a standard recording angle $\alpha$ which is equal to 90°. The cylindrical coils 3 and 4 of each channel 1 and 2 represent single-section structures so disposed relative to the respective magnets 5 and 6 that each coil 3 or 4 encompasses both poles N and S of its magnet 5 or 6, while longitudinal axes thereof coincide with the longitudinal axis of the stylus holder 7 and are perpendicular, respectively, to the axes 9 and 10 of the magnets 5 and 6 along the N-S line.

In the preferred embodiment of the invention the cylindrical coils 3 and 4 (FIG. 2) of each channel 1 and 2 are circular in cross-section and surrounded by cylindrical core structures 11 and 12 which suit the shape of the coils 3 and 4.

On the side of the channels 1 and 2 the core structures 11 (FIG. 1) and 12 are provided with annular sections 13 and 14 acting as magnetic shields to decrease the effect of the magnet 6 of the channel 2 on the coil 3 of the channel 1 and also the effect of the magnet 5 of the channel 1 on the coil 4 of the channel 2.

Each coil 3 and 4 has individual leads 15 and 16 to connect the cartridge to the input of an amplifier (not shown in the drawing).

To provide better separation of the channels 1 (FIG. 3) and 2 and also to decrease mutual interference in the cartridges, according to the invention, cylindrical coils 17 and 18 of each reproduction channel 1 and 2 have elongated shape and are oriented so that their turns are close, respectively, to the poles N and S of the magnets 5 and 6 of the corresponding channel 1 and 2 and far from the poles N and S of the magnets 6 and 5 of the other channel 2 and 1, respectively.

The coils 17 and 18 are surrounded, respectively, by core structures 19 and 20 which suit the shape of the coils 17 and 18.

The operating principle of the electrodynamic pickup cartridge forming the subject of the present invention is as follows.

As the stylus 8 (FIG. 1) follows the modulations of a record groove, it transmits the oscillations thus derived to the stylus holder 7 which oscillates about a point 0. The magnets 5 and 6 will oscillate with respect to the point 0 to suit the oscillations of the stylus 8. The point 0 is an attachment point of the stylus holder 7. The oscillations of the magnets 5 and 6 relative to the point 0 have an intricate curvilinear path which can be resolved into vertical and horizontal components.

In the cartridge according to the invention the e.m.f. is produced as the magnets 5 and 6 oscillate along the horizontal component, said motion being similar to the motion of a frame in a magnetic field. In this case, however, the moving elements are the magnets 5 and 6. If, for example, the north pole N of the magnet 6 moves in one direction, its south pole S will move in the opposite direction and vice versa.

The core structures 11 and 12 surround the coils 3 and 4 with a view to aligning and concentrating lines of magnetic force of the magnets 5 (FIGS. 1, 2) and 6 and directing them through the turns of said coils. This allows appreciably increasing the e.m.f. and reducing mutual interference between the channels 1 and 2.

The annular sections 13 and 14 of the core structures 11 and 12 provide better shielding between the channels 1 and 2.

To decrease still further the e.m.f. obtained due to the mutual effect of the magnets 5 (FIG. 3) and 6 on the adjacent channels 2 and 1, the coils 17 and 18 have elongated shape, which permits locating the turns of the respective coil near the poles N and S of its magnet and far from the poles of the adjacent magnet. In FIG. 3, for example, the turns of the coil 18 are near the poles N and S of the magnet 6 and far from the poles N and S of the magnet 5.

The cartridge in compliance with the present invention makes it possible to replace a stylus holder containing a stylus by using a simple procedure involving installation of the holder enclosed, for example, in a tube into the coil without disassembly and removal of the cartridge from the operating record player.

The cartridge forming the subject of the present invention has simplier construction and a lesser number of parts as compared with the prior art electrodynamic pickup cartridges.

The cartridge according to the invention includes no pole shoes and bulky magnets to produce a uniform magnetic field, an advantage reducing its weight to some 2–2.5 g. Furthermore, it does not have any movable coil leads, a feature appreciably enhancing operational reliability thereof.

INDUSTRIAL USE

The electrodynamic pickup cartridge forming the subject of the present invention may be used in first-and high-class record players.

What is claimed is:

1. An electrodynamic pickup cartridge comprising two reproduction channels provided with cylindrical coils accommodating permanent magnets installed on a stylus holder which is common to both of said two reproduction channels and which carries a stylus, unlike poles of each said permanent magnet projecting on both sides of the stylus holder, each said permanent magnet having an N-S line of polarity defining an axis of each said permanent magnet, said axes along the N-S lines of said permanent magnets being in planes crossing at a standard recording angle, wherein the cylindrical coil of each reproduction channel represents a single-section structure so disposed relative to its corresponding permanent magnet that the cylindrical coil of each reproduction channel encompasses both poles of said corresponding permanent magnet and has a longitudinal axis which is perpendicular to the axis of said corresponding permanent magnet along the N-S line of said corresponding permanent magnet.

2. A cartridge according to claim 1, wherein the cylindrical coil of each reproduction channel has turns and is elongated in cross-section and is oriented so that the turns are close to the poles of said corresponding permanent magnet of said each reproduction channel and far from the poles of the permanent magnet of the other reproduction channel.

* * * * *